US005641029A

United States Patent [19]

Beaton et al.

[11] Patent Number: 5,641,029

[45] Date of Patent: Jun. 24, 1997

[54] ROTARY CONE DRILL BIT MODULAR ARM

[75] Inventors: Michael S. Beaton, Cedar Hill; Jay S. Bird, Waxahachie, both of Tex.

[73] Assignee: Dresser Industries, Inc., Dallas, Tex.

[21] Appl. No.: 478,455

[22] Filed: Jun. 6, 1995

[51] Int. Cl.[6] ..... E21B 10/20

[52] U.S. Cl. ..... 175/356; 76/108.2; 175/366; 175/375

[58] Field of Search ..... 175/366, 367, 175/368, 369, 356, 357, 375; 76/108.2, 108.4

[56] References Cited

U.S. PATENT DOCUMENTS

| | | | |
|---|---|---|---|
| Re. 19,339 | 10/1934 | Vertson | 255/73 |
| Re. 32,495 | 9/1987 | Coates | 175/339 |
| 1,906,427 | 5/1933 | Sievers et al. . | |
| 1,908,049 | 5/1933 | Reed . | |
| 2,030,723 | 2/1936 | Scott et al. | 255/71 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 255/71 |
| 2,068,375 | 1/1937 | Catland | 175/357 |
| 2,124,521 | 7/1938 | Williams et al. | 255/71 |
| 2,151,347 | 3/1939 | Fisher | 255/71 |
| 2,176,358 | 10/1939 | Pearce | 255/71 |
| 2,260,487 | 10/1941 | Scott | 225/71 |
| 2,318,370 | 5/1943 | Burch | 255/71 |
| 2,648,526 | 8/1953 | Lanchester | 255/71 |
| 2,782,005 | 2/1957 | Appleton | 255/340 |
| 2,807,444 | 9/1957 | Reifschneider | 175/375 |
| 2,950,090 | 8/1960 | Swart | 175/375 |
| 3,130,801 | 4/1964 | Schumacher, Jr. | 175/374 |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | Mcqueen | 175/228 |
| 4,054,772 | 10/1977 | Lichte | 219/121 |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Vezirian | 308/8.2 |
| 4,187,743 | 2/1980 | Thomas | 76/108.2 |
| 4,209,124 | 6/1980 | Baur et al. | 228/182 |
| 4,256,194 | 3/1981 | Varel | 175/375 |
| 4,258,807 | 3/1981 | Fischer et al. | 175/375 |
| 4,280,571 | 7/1981 | Fuller | 175/337 |
| 4,333,364 | 6/1982 | Varel | 76/108 |
| 4,350,060 | 9/1982 | Vezirian | 76/108 |
| 4,352,400 | 10/1982 | Grappendorf et al. | 175/330 |
| 4,369,849 | 1/1983 | Parrish | 175/340 |

(List continued on next page.)

FOREIGN PATENT DOCUMENTS

| | | | |
|---|---|---|---|
| 936382 | 12/1955 | Germany . | |
| 533719 | 10/1976 | U.S.S.R. . | |
| 732483 | 5/1980 | U.S.S.R. | 175/366 |
| 1305295 | 4/1987 | U.S.S.R. . | |
| 1467157 | 3/1989 | U.S.S.R. . | |

OTHER PUBLICATIONS

Security/Dresser "Security Oilfield Catalog" Rock Bits, Diamond Products, Drilling Tools, *Security Means Technology*, Nov. 1991–Nov.1992.

"State of the Science in Rock Bit Tech." by Carlos Fernandez, SPACEBIT, Aug. 8, 1991.

*Primary Examiner*—Hoang C. Dang
*Attorney, Agent, or Firm*—Baker & Botts, L.L.P.

[57] ABSTRACT

A drill bit (20) for a modular arm (70) is provided. The modular arm (70) includes an inside surface (76) having first (144) and second (146) angled surfaces whose lower portions form an inwardly projecting wedge (125). A curved throat relief area (87) connects to a lower edge (152) of the wedge (125). A pocket (54) in the drill bit (20) is sized to receive the support arm (70). The pocket (54) includes a wedge-shaped recess (121) sized to receive the wedge (125) of the support arm (70). A triangular weld groove (126) is provided in the convex surface of the bit body (40). A length of weld (128) is applied in the weld groove (126) for firmly securing the support arm (70) to the bit body (40).

20 Claims, 4 Drawing Sheets

U.S. PATENT DOCUMENTS

| | | | |
|---|---|---|---|
| 4,417,629 | 11/1983 | Wallace | 175/356 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 1/1986 | Evans et al. | 175/374 |
| 4,630,693 | 12/1986 | Goodfellow | 175/366 |
| 4,635,728 | 1/1987 | Harrington | 166/341 |
| 4,657,091 | 4/1987 | Higdon | 175/369 |
| 4,711,143 | 12/1987 | Loukanis et al. | 76/108 |
| 4,727,943 | 3/1988 | Wood | 175/229 |
| 4,750,573 | 6/1988 | Wynn | 175/359 |
| 4,765,205 | 8/1988 | Higdon | 76/108 |
| 4,813,502 | 3/1989 | Dysart | 175/337 |
| 4,817,852 | 4/1989 | Hill | 228/114 |
| 4,848,491 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett et al. | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,289,889 | 3/1994 | Gearhart et al. | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler et al. | 175/356 |

22
44
42
40
28
24
26
20
46
48
60
70
70
100
104
104
100

ROTARY CONE DRILL BIT MODULAR ARM

TECHNICAL FIELD OF THE INVENTION

This invention relates in general to rotary drill bits used in drilling a borehole in the earth and in particular to a drill bit having an improved modular arm.

BACKGROUND OF THE INVENTION

Various types of rotary drill bits or rock bits may be used to form a borehole in the earth. Examples of such bits include roller cone bits or rotary cone bits often used in drilling oil and gas wells. A typical roller cone bit comprises a bit body with an upper end adapted for connection to a drill string. A plurality of support arms, typically three in number, depend from the lower portion of the bit body with each arm having a spindle protruding downwardly from said bit body and radially and inwardly with respect to a projected rotational axis of the bit body.

For some applications, modular construction techniques have been used to fabricate drill bits from a bit body and modular support arms. Such modular support arms often included a flat locating face extending in an undeviated or line of sight path to the bit exterior, requiring that the length of the weld bead be perpendicular to a radial line extending from the center of the bit. This section of the weld joint or weld bead perpendicular to a radial line running from the center of the bit is known as the straight section of the weld bead. The profile of the arm approaching the area where the weld was deposited near a pocket formed in the bit body was commonly straight.

SUMMARY OF THE INVENTION

In accordance with the present invention, the disadvantages and problems associated with previous rolling cone drill bits have been substantially reduced or eliminated. In one aspect of the present invention, a modular support arm is provided, which has a top surface, an inside surface, an exterior surface with a shirttail formed as a part thereof, and a bottom edge. The inside surface and the shirttail surface are contiguous at the bottom edge. The support arm has a first side and a second side extending from the inside surface. The inside surface of the support arm includes first and second angled surfaces, the lower portions of which form an inwardly projecting wedge from the inside surface of the support arm which forms an upper surface and a lower edge on the wedge. The wedge-shaped projection is located on the inside of the modular arm longitudinally between the journal end of the modular arm and the locating features or openings on the inside surface of the modular arm. Portions of the support arm, such as the top surface and the inside surface, are sized to allow securing of a portion of the support arm within a pocket formed in the bit body. Depending upon the application, multiple recesses and projecting wedge's may be utilized.

The inside surface of the support arm includes means for aligning and positioning the support arm within the pocket during fabrication of the drill bit. The pocket in the bit body is sized to receive the support arm and typically includes a back wall, a wedge-shaped recess having the general shape of a wedge with a rounded apex, a lower surface coupled to the back wall at the lowermost edge, and opposed inclined sides extending outwardly from the back wall. The inclined sides and the lower surface form the wedge-shaped recess sized to receive the inwardly projecting wedge of the support arm.

A spindle is attached to the inside surface near its bottom edge and angled downwardly and inwardly with respect to the support arm. A cutter cone assembly is provided with an opening and a chamber for mounting the cutter cone assembly on the spindle.

One advantage of the present invention is that the wedge-shaped triangular projection and its matching wedge-shaped recess, when welded together, results in a triangular shaped weld joint which reduces the tensile loading across the weld joint. The reduction in tensile loading across the weld joint substantially reduces the likelihood of cracking in the weld joint. The projection of the wedge-shaped portion into the machined pocket of the bit also lengthens the weld bead over which stresses can be distributed and thereby further reduces the tensile loading across the weld joint.

The stresses are transferred from the arm to the body through contact of the upper surface of the projection to the lower surface of the pocket. This has the effect of increasing the area over which the stresses are transferred and allows for a smooth transition of the stresses from the arm to the body without the stresses being concentrated in any singe area of the arm or the body. Additionally, the profile of the arm is blended gradually into the wedge-shaped projection so that stresses are transferred through the arm without concentration in any single area of the arm.

Further advantages are realized by relocating the weld heat affected zone from the heavily loaded portion of the arm to a lower stressed inboard portion. Thus, the projection serves to distribute stresses imposed by manufacturing the bit so that stresses are benign to the structural integrity of the welded support arms. Without this projection, cracks may form as a result of manufacturing and operationally imposed stresses across the weld attaching the arm to the body.

Additionally, the adoption of a generally triangular configuration for the wedge reduces the number of segments of welding and the necessity for the welder to reach around behind the arm to weld the isolated central segment. The welder is therefore able to produce a sounder weld with minimal overlaps and undercuts. The configuration resulting from the teaching of the present invention is less fatiguing for the welder.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiments of the present invention and its advantages are best understood by referring to FIGS. 1–7 of the drawings, like numerals being used for like and corresponding parts of the various drawings.

For purposes of illustration, the present invention is shown embodied in rotary cone drill bit 20 of the type used in drilling a borehole in the earth. Rotary cone drill bit 20 may sometimes be referred to as a "rotary drill bit" or "rock bit." Rotary cone drill bit 20 preferably includes threaded connection or pin 44 for use in attaching the drill bit 20 with drill string 22. Threaded connection 44 and the corresponding threaded connection (not shown) associated with drill string 22 are designed to allow rotation of drill bit 20 in response to rotation of drill string 22 at the well surface.

Figure 1:
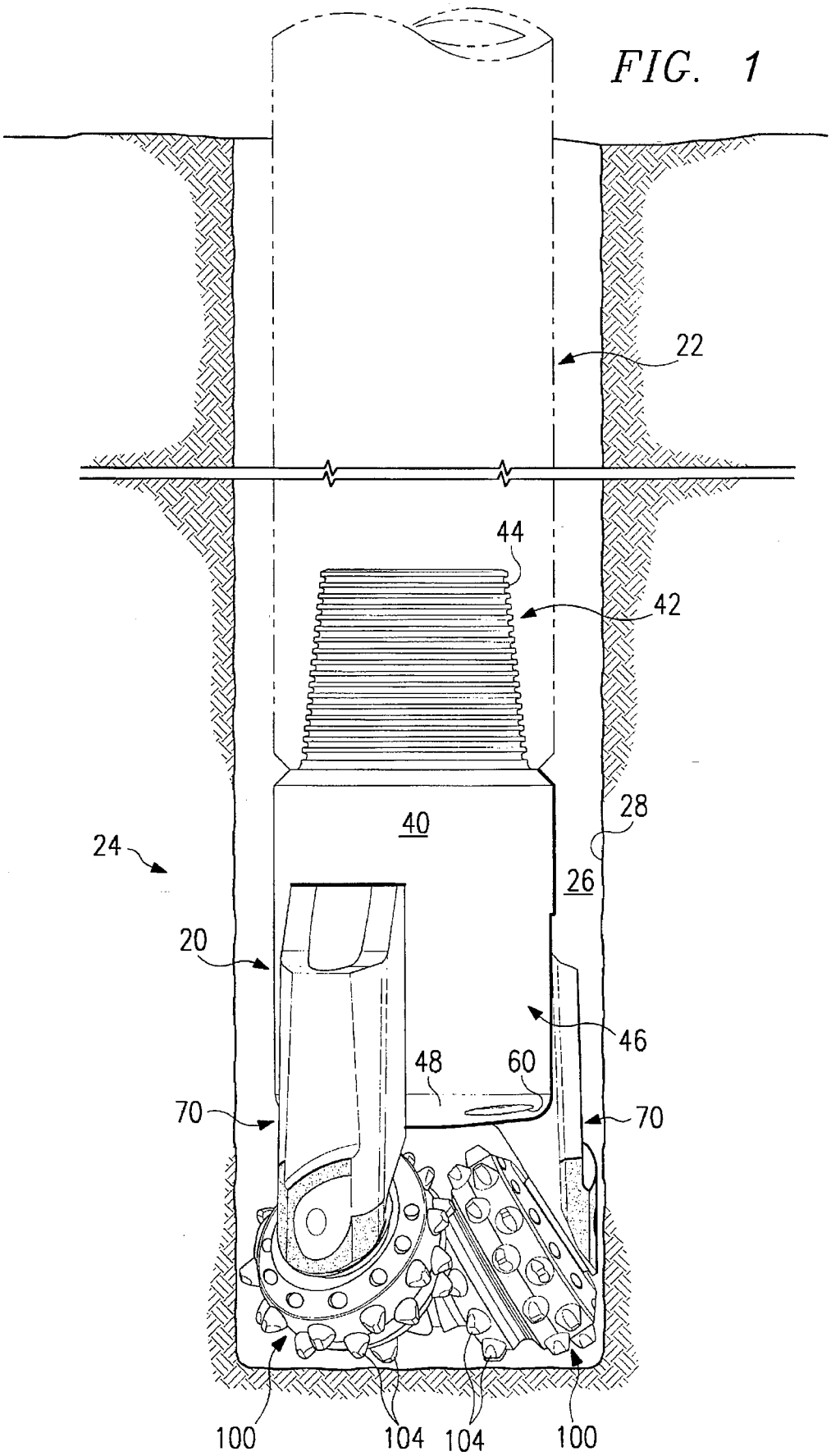
FIG. 1 is a schematic drawing in elevation and section with portions broken away of a rotary cone drill bit, incorporating features of the present invention attached to one end of a drill string disposed in a borehole.

In FIG. 1, drill bit 20 is shown attached to drill string 22 and disposed in borehole 24. Annulus 26 is formed between the exterior of drill string 22 and the interior or wall 28 of borehole 24. In addition to rotating drill bit 20, drill string 22 is often used to provide a conduit for communicating drilling fluids and other fluids from the well surface to drill bit 20 at the bottom of borehole 24. Such drilling fluids may be directed to flow from drill string 22 to various nozzles 60 provided in drill bit 20. Cuttings formed by drill bit 20 and any other debris at the bottom of borehole 24 will mix with the drilling fluids exiting from nozzles 60 and return to the well surface via annulus 26.

For rotary cone drill bit 20 cutting action or drilling action occurs as cutter cone assemblies 100 are rolled around the bottom of borehole 24 by rotation of drill string 22. The resulting inside diameter of borehole 24 defined by wall 28 corresponds approximately with the combined outside diameter or gage diameter of cutter cone assemblies 100. Cutter cone assemblies 100 cooperate to cut the diameter of borehole 24 defined by wall 28 in response to rotation of drill bit 20. Cutter cone assemblies 100 may sometimes be referred to as "rotary cone cutters" or "roller cone cutters."

Figure 2:
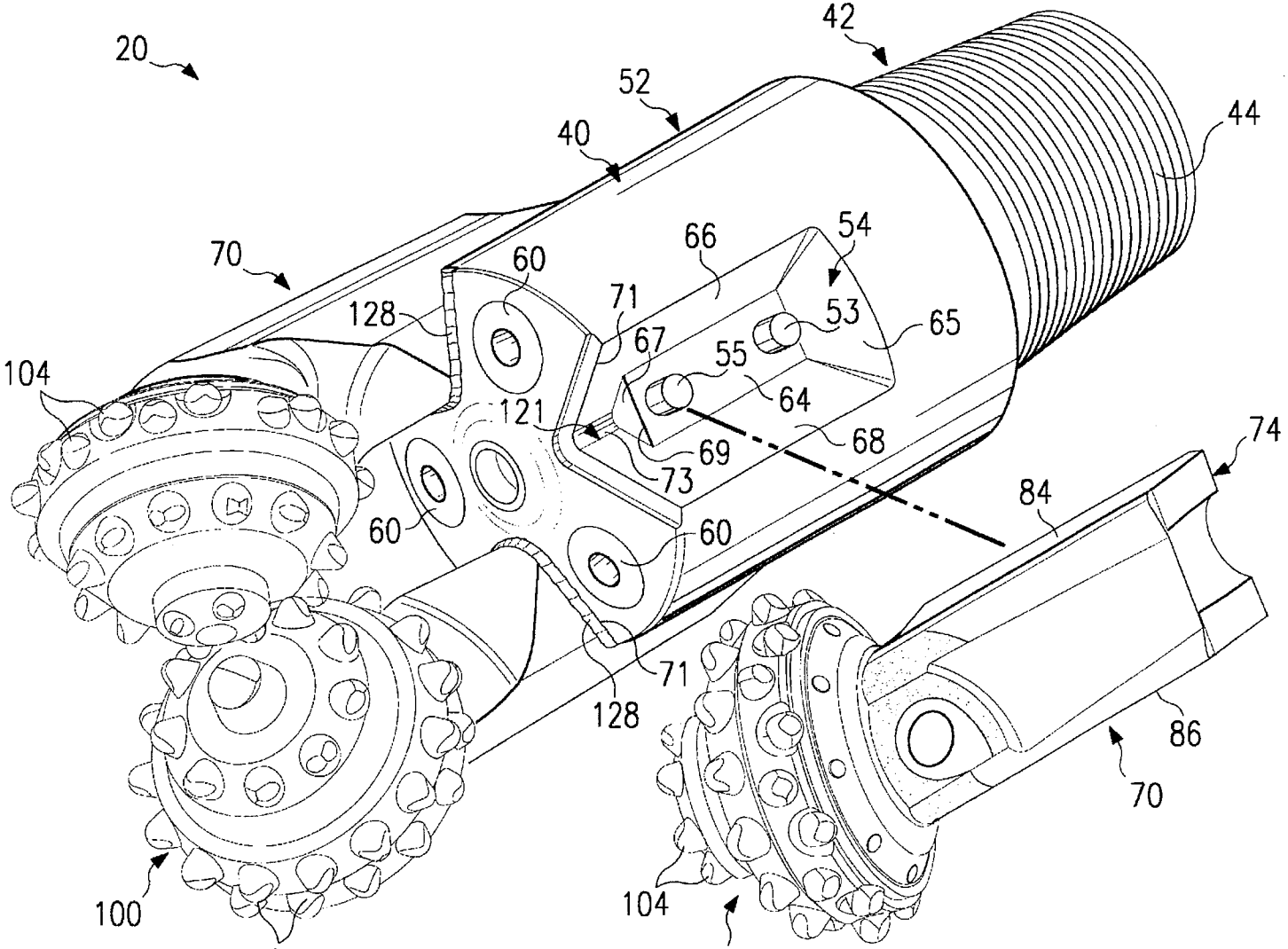
FIG. 2 is an isometric drawing showing a partially exploded view of a rotary cone drill bit incorporating an embodiment of the present invention.
Figure 3:
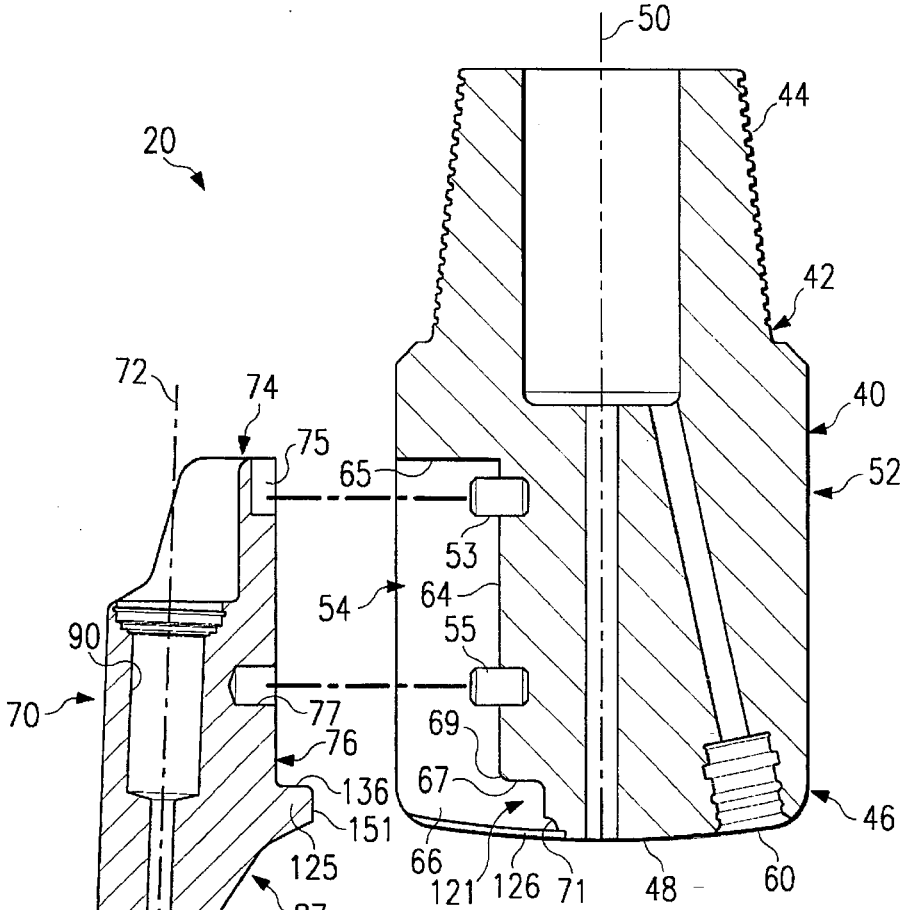
FIG. 3 is an exploded drawing in sections showing portions of a one-piece bit body, support arm, and cutter cone assembly incorporating an embodiment of the present invention.

As shown in FIGS. 1, 2, and 3, each cutter cone assembly 100 includes protruding inserts 104 which scrape and gouge against the sides and bottom of borehole 24 in response to weight and rotation applied to drill bit 20 from drill string 22. The position of the inserts 104 for each cutter cone assembly 100 may be varied to provide the desired downhole cutting action. Other types of cutter cone assemblies may be satisfactorily used with the present invention including, but not limited to, cutter cone assemblies having milled teeth instead of inserts 104.

Drill bit 20 preferably comprises a one-piece or unitary bit body 40 with upper portion 42 having threaded connection or pin 44 adapted thereto to secure drill bit 20 to the lower end of drill string 22. Three support arms 70 are preferably attached to and extend longitudinally from bit body 40 opposite from pin 44. Each support arm 70 preferably includes a spindle 82 connected to and extending from inside surface 76 of the respective support arm 70.

Bit body 40 includes lower portion 46 having a generally convex exterior surface 48 formed thereon. The dimensions of convex surface 48 and the location of cutter cone assemblies 100 are selected to optimize fluid flow between lower portion 46 of bit body 40 and cutter cone assemblies 100. The location of cutter cone assemblies 100 relative to lower portion 46 may be varied by adjusting the length of the associated support arm 70 and the spacing of each support arm 70 on the exterior of bit body 40.

Bit body 40 has a number of pockets 54 formed in the exterior thereof and spaced radially from each other. The number of pockets 54 is selected to correspond to the number of support arms 70 to be attached thereto. The spacing of pockets 54 with respect to each other in the exterior of bit body 40 is selected to correspond with the desired spacing of support arms 70 and associated cutter cone assemblies 100.

As shown in FIG. 2, each of the pockets includes back wall 64 and two inclined side walls 66 and 68 angled outwardly from back wall 64. Back wall 64 begins at upper surface 65 of pocket 54 and extends longitudinally through a portion of pocket 54. The dimensions of back wall 64, and side walls 66 and 68 are selected to be compatible with the adjacent inside surface 76, sides 132 and 134, and top surface 74 of the associated support arm 70. First and second posts 53 and 55 are positioned on back wall 64 and are sized to receive first and second openings 75 and 77 of an associated support arm 70.

Figure 7:
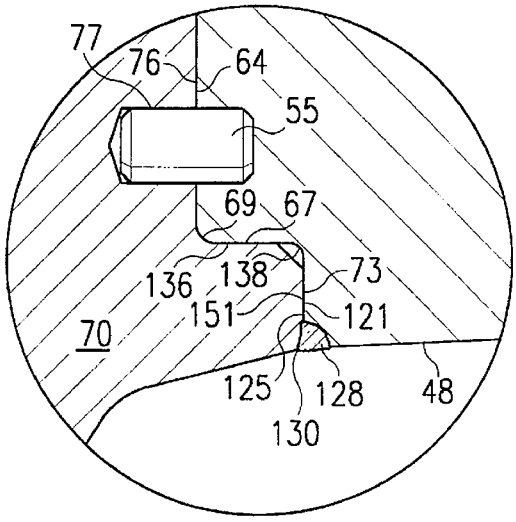
FIG. 7 is a drawing in section with portions broken away of a unitary bit body having a support arm attached thereto in accordance with an embodiment of the present invention.

Near the lower portion of pocket 54, a wedge-shaped recess 121 is formed by lower surface 67 of pocket 54 and side walls 66 and 68. Lower surface 67 of pocket 54 is generally triangular in shape. The connection of one side of triangularly-shaped lower surface 67 and back wall 64 preferably forms a radiused or rounded edge 69. Similarly, as shown in FIG. 7, the connection of lower surface 67 and side walls 66 and 68 forms an apex or rounded corner 73. The combination of lower surface 67 and side walls 66 and 68, together forming wedge-shaped recess 121, is sized to receive wedge-shaped projection 125, shown in FIG. 4, of support arm 70. Wedge 125 is designated as an inwardly projecting wedge because it projects inwardly with respect to longitudinal axis 50 of bit body 40. Additional inwardly projecting wedges and matching recesses may be used with the present invention.

Weld groove 126 is formed on convex surface 48 of bit body 40 and runs along lowermost edge 71 of each pocket 54. Upon placement of support arm 70 in its associated pocket 54, a length of weld 128, as shown in FIG. 7, is applied in weld groove 126 to firmly secure each support arm 70 to bit body 40.

FIG. 3 is an exploded drawing that shows the relationship between bit body 40, and one of the support arms 70 and its associated cutter cone assembly 100. Bit body 40 includes middle portion 52 disposed between upper portion 42 and lower portion 46. Longitudinal axis or central axis 50 extends through bit body 40 and corresponds generally with the projected axis of rotation for drill bit 20. Middle portion 52 preferably has a generally cylindrical configuration with pockets 54 formed in the exterior thereof and spaced radially from each other. The number of pockets 54 is selected to correspond with the number of support arms 70 which will be attached thereto. The spacing of pockets 54 with respect to each other in the exterior of middle portion 52 is selected to correspond with the desired spacing of support arms 70 and their associated cutter cone assemblies 100 with respect to longitudinal axis 50 and the projected axis of rotation for drill bit 20.

Each support arm 70 has a longitudinal axis 72 extending therethrough. Support arms 70 are preferably mounted in their respective pockets 54 with their respective longitudinal axis 72 aligned substantially parallel with each other and with longitudinal axis 50 of the associated bit body 40.

Each support arm 70 is preferably welded within its associated pocket by a series of welds, not all of which are shown. Weld groove 126 is formed on convex surface 48 and runs along lowermost edge 71 of pocket 54. Weld 128 is placed in weld groove 126 to assist in securing each support arm 70 to bit body 40. Weld groove 126 and weld 128 are of a generally triangular configuration, corresponding approximately to the lower perimeter of wedge 125. Because of the triangular configuration of weld groove 126, weld 128 does not include any length that is perpendicular to a radial line extending from longitudinal axis 50 of drill bit 20. The absence of such a length of weld reduces the tensile stresses from the attachment of support arm 70 to bit body 40 at its associated weld groove 126.

Each cutter cone assembly 100 is preferably constructed and mounted on its associated spindle 82 in a substantially identical manner. Each support arm 70 is preferably constructed and mounted in its associated pocket 54 in substantially the same manner. Therefore, only one support arm 70 and cutter cone assembly 100 will be described in detail since the same description applies generally to the other two support arms 70 and their associated cutter cone assemblies 100.

Support arm 70 has a generally rectangular configuration with respect to longitudinal axis 72. Support arm 70 may have various cross-sections taken normal to longitudinal axis 72, depending upon the configuration of the associated pocket 54 and other features which may be incorporated into support arm 70 in accordance with the teachings of the present invention. Support arm 70 includes top surface 74, inside surface 76, bottom edge 78, and exterior surface 80. Support arm 70 also includes sides 84 and 86 which preferably extend parallel to each other and longitudinal axis 72. The dimensions and configuration of each support arm 70 are selected to be compatible with the associated pocket 54. As shown in FIGS. 2 and 3, a portion of each support arm 70, including the top surface 74 and adjacent portions of inside surface 76, is sized to fit within the associated pocket 54.

Inside surface 76 includes center portion 142 with angled surfaces 144 and 146 formed adjacent thereto. The configuration of inside surface 76 may be varied substantially between top surface 74 and bottom edge 78. Inside surface 76 and exterior surface 80 are contiguous at bottom edge 78 of support arm 70. The portion of exterior surface 80 formed adjacent to bottom edge 78 is often referred to as shirttail surface 88.

Spindle 82 is preferably angled downwardly and inwardly with respect to both longitudinal axis 72 of support arm 70 and the projected axis of rotation of drill bit 20. This orientation of spindle 82 results in the exterior of cutter cone assembly 100 engaging the side and bottom of borehole 24 during drilling operations. For some applications, it may be preferable to position each support arm 70 and its associated spindle 82 with cutter cone assembly 100 at an offset from the projected axis of rotation of drill bit 20. The desired offset can be easily obtained by forming the associated pockets 54 in the exterior of bit body 40 with a corresponding offset from longitudinal axis 50 of bit body 40. The amount of offset may vary from zero to five or six degrees or zero inches to one-half inch in the direction of rotation of drill bit 20.

As shown in FIG. 3, each cutter cone assembly 100 preferably includes base portion 108 with a conically shaped shell or nose 106 extending therefrom. For some applications, base portion 108 includes a frustoconically shaped outer surface 110 which is preferably angled in a direction opposite from the angle of shell 106. Base 108 also includes backface 112 which may be disposed adjacent to portions of inside surface 76 of the associated support arm 70.

Base portion 108 preferably includes opening 120 with chamber 114 extending therefrom. Chamber 114 preferably extends through base 108 and into nose 106. The dimensions of opening 120 in chamber 114 are selected to allow mounting of each cutter cone assembly 100 on its associated spindle 82. One or more bearing assemblies 122 are preferably mounted on spindle 82 and disposed between a bearing wall (not shown) within chamber 114 and annular bearing surface 81 on spindle 82.

Cutter cone assembly 100 may be retained on its associated spindle 82 by inserting a plurality of ball bearings 124 through ball passageway 96 extending from exterior surface 80 of support arm 70 through spindle 82. A matching ball race (not shown) will typically be provided on the interior of cutter cone assembly 100. Once inserted, ball bearings 124 in cooperation with ball race 98 and the matching ball race (not shown) on cutter cone assembly 100 will prevent disengagement of cutter cone assembly 100 from spindle 82. Ball passage 96 may be subsequently plugged by welding or other well-known techniques. For some applications, a ball plug (not shown) may also be placed in passageway 96.

As shown in FIG. 3, a portion of top surface 74, exterior surface 80, and adjacent sides 84 and 86 have been removed from the upper portion of support arm 70 to provide cavity 90 for installing a lubricant reservoir (not shown) therein.

Figure 4:
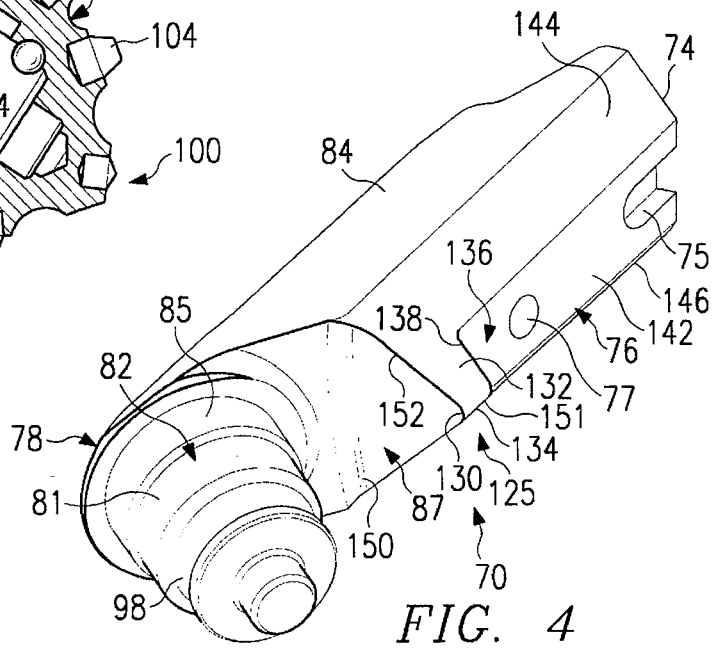
FIG. 4 is an isometric drawing of the support arm of the present invention.
Figure 5:
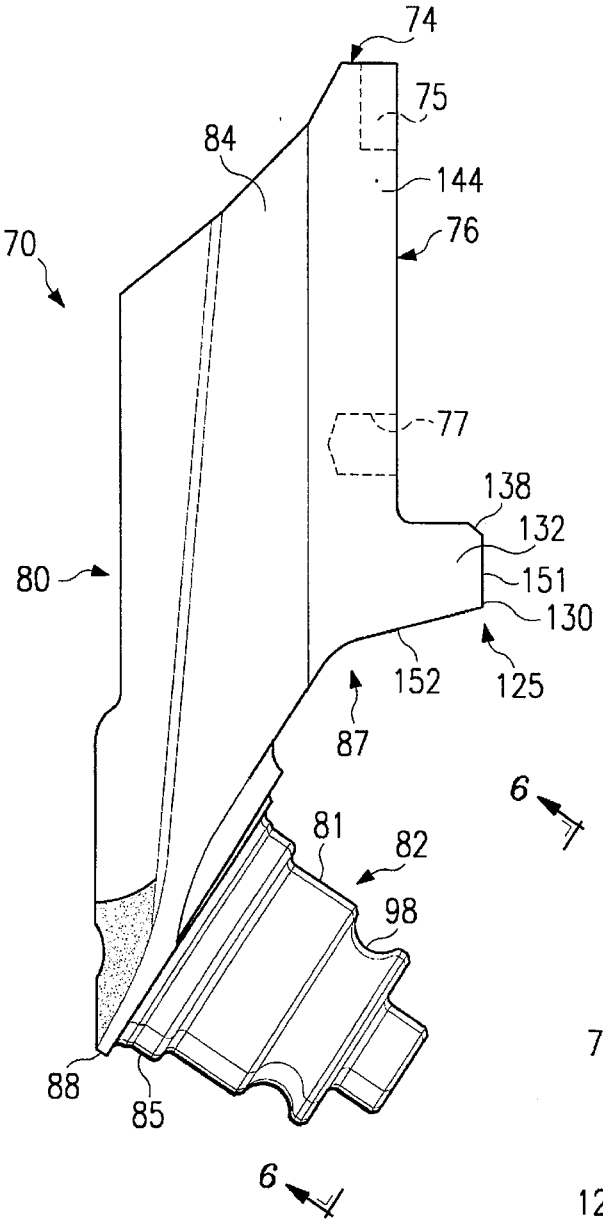
FIG. 5 is a drawing in elevation of the support arm shown in FIG. 4.

For one embodiment of the present invention as shown in FIGS. 4 and 5, first opening 75 and second opening 77 are formed on inside surface 76 of each support arm 70. First post 53 and second post 55 are preferably located in back wall 64 of each pocket 54. Posts 53 and 55 extend radially from each back wall 64 to receive, respectively, first opening 75 and second opening 77 so as to position each support arm 70 within its associated pocket 54. For one embodiment of the present invention, first opening 75 preferably comprises a longitudinal slot extending from top surface 74 and sized to receive first post 53 therein. Second opening 77 preferably has a generally circular configuration sized to receive second post 55 therein. First opening 75 is preferably formed as a longitudinal slot to compensate for any variation between the dimensions of support arm 70 and its associated pocket 54 including the relative position of first opening 75, second opening 77, and respective first post 53 and second post 55.

As shown in FIG. 4, inside surface 76 of support arm 70 preferably includes center portion 142 with angled surfaces 144 and 146 extending longitudinally from top surface 74 to throat relief area 87 formed on the lower portion of inside surface 76.

Inwardly projecting wedge 125 has first and second inclined sides 132 and 134 extending from angled surfaces 144 and 146 of inside surface 76. The meeting of inclined sides 132 and 134 forms a rounded apex 151 of wedge 125. An upper surface 136 extends from center portion 142 to sides 132 and 134, forming an upper edge 138 of wedge 125. Upper surface 136 is substantially perpendicular to center portion 142. As shown in FIGURE 5, upper edge 138 may be chamfered. Alternatively, upper edge 138 may be rounded or radiused.

Because center portion 142 and upper surface 136 are positioned against back wall 64 and lower surface 67, respectively, when the support arm 70 is placed in pocket 54, upper surface 136 and center portion 142 are machined to provide locating surfaces for easy assembly of support arm 70 in pocket 54. Wedge 125 is sized to fit within wedge-shaped recess 121 of pocket 54.

The throat relief area 87 of support arm 70 gradually curves upwardly from spindle 82 and ridges 150 to its connection with lower edge 152 of wedge 125. Throat relief area 87 and wedge 125 are contiguous at lower edge 152. Lower edge 152 is upwardly curving, triangular in shape, and includes an outermost point 130. Support arm 70 is positioned in pocket 54 so that outermost point 130 is adjacent lowermost edge 71 of pocket 54. Once support arm 70 is positioned in a respective pocket 54, weld 128 is placed in weld groove 126 to firmly anchor support arm 70 to bit body 40.

Figure 6:
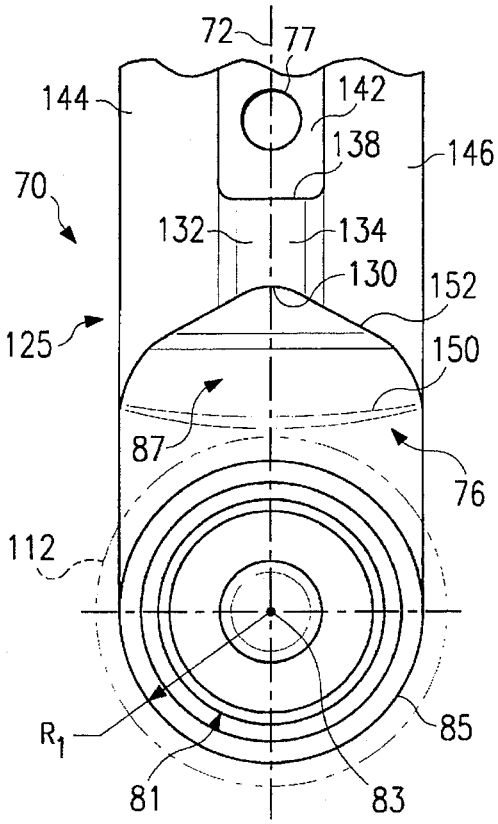
FIG. 6 is a drawing taken along line 6—6 of FIG. 5.

FIG. 6 shows the lower portion of support arm 70 viewed along line 6—6 of FIG. 5. Spindle 82 includes axis 83 extending from inside surface 76 of support arm 70. A generally circular, flat machined surface 85 is preferably formed adjacent the junction between inside surface 76 of support arm 70 and spindle 82. Machined area 85 may sometimes be referred to as the "last machined surface or LMS" of support arm 70. Machined surface 85 preferably has a generally circular configuration defined by radius $R_1$ as shown in FIG. 6 extending from axis 83 of spindle 82 which results in machined surface 85 extending uniformly through three hundred sixty degrees around axis 83 of spindle 82. Machined surface 85 and its associated radius $R_1$ cooperate with exterior surface 80 to partially define shirttail surface 88 and bottom edge 78 of support arm 70. Dotted line 112 shown in FIG. 6 corresponds to the outside diameter of backface 112.

Extending from spindle 82 and ridges 150 to lower edge 152 of FIG. 6 is throat relief area 87. First and second angled surfaces 144 and 146 extend from first and second sides 132 and 134, respectively, of wedge 125. First and second sides 132 and 134 lie between upper edge 138 and lower edge 152 of wedge 125. Second opening 77 is formed on center portion 142.

FIG. 7 shows the placement of support arm 70 in pocket 54 of bit body 40. Wedge 125 is positioned within wedge-shaped recess 121. A weld 128 within weld groove 126 secures support arm 70 to pocket 54 of bit body 40.

As shown in FIG. 1, once support arm 70 is positioned in pocket 54 such that outermost point 130 is adjacent lowermost edge 71 of pocket 54, a length of weld 128 is placed in weld groove 126 to firmly secure support arm 70 to bit body 40. Weld 128 is triangular in shape and lacks any length that is perpendicular to a straight line running from longitudinal axis 50 of bit body 40. The absence of such a section of weld 128 prevents the application of purely tensile stresses in the area of weld 128. The gradual curvature of throat relief area 87 provides a means by which the stresses of support arm 70 are transferred uniformly to bit body 40, without concentration in any single site on the support arm 70 or bit body 40. The stresses from the support arm 70 are transferred to the bit body 40 through the longitudinal contact of wedge 125 with lower surface 67 of pocket 54. The transfer of the stresses through wedge 125 further reduces the stresses on weld 128 which has the effect of reducing the possibility of cracking in weld 128.

Although the present invention has been described in great detail, it should be understood that various changes, substitutions, and alterations can be made hereto without departing from the spirit and scope of the invention as defined by the appended claims.

What is claimed is:

1. A support arm and cutter cone assembly for a drill bit having a bit body, comprising:

said support arm having a top surface, an inside surface, an exterior surface with a shirttail surface formed as a part thereof, and a bottom edge, with said inside surface and said shirttail surface contiguous at said bottom edge;

said inside surface of said support arm comprising:

first and second angled surfaces, the lower portions of said angled surfaces forming a wedge projecting from said inside surface, said wedge having a lower edge and an upper edge;

a center portion including a flat surface extending between said first and second angled surfaces; and a triangular upper surface extending perpendicularly from said center portion to said upper edge of said wedge; a throat relief area connected to said lower edge of said wedge; the dimensions of said top surface and said inside surface selected to allow securing a portion of said support and within a pocket formed in said bit body, and the dimensions of said wedge selected to allow securing said wedge within a wedge-shaped recess formed in said pocket in said bit body;

a spindle attached to said inside surface near said bottom edge and angled downwardly and inwardly with respect to said support arm; and means provided on said inside surface of said support arm for alignment and positioning of said support arm within said pocket during fabrication of said drill bit.

2. The support arm and cutter cone assembly of claim 1, wherein said means for alignment comprises a post corresponding to an opening.

3. The support arm and cutter cone assembly of claim 1, wherein said means for alignment comprises a first and second post corresponding to a first and second opening, wherein said first opening is a longitudinal slot.

4. The support arm and cutter cone assembly of claim 1, wherein said inside surface comprises said wedge.

5. The support arm and cutter cone assembly of claim 1, wherein said throat relief area curves upwardly from said spindle to said wedge.

6. The support arm and cutter cone assembly of claim 1, wherein said center portion blends smoothly into said upper edge of said wedge.

7. The support arm and cutter cone assembly of claim 1, wherein said upper edge of said wedge is chamfered.

8. A method for fabricating a modular support arm for a drill bit having a bit body, comprising the steps of:

forming a support arm having a top surface;

forming an inside surface on said support arm;

forming a center portion including a flat surface with first and second angled surfaces on opposing sides of said flat surface;

forming a wedge-shaped projection on said inside surface connected between said first and second angled surfaces such that the dimensions of said wedge-shaped projection are sized to allow securing said wedge-shaped projection within a wedge-shaped recess in a pocket formed in said bit body;

forming an upper surface on said wedge-shaped projection extending from said center portion such that the dimensions of said top surface and said inside surface of said support arm are sized to allow securing a portion of said support arm within said pocket formed in said bit body;

forming a throat relief area extending from said wedge-shaped projection; and forming means on said inside surface for alignment and positioning of said support arm within said pocket of said bit body.

9. The method for fabricating a modular support arm of claim 8, wherein said step of forming an upper surface includes the steps of:

forming said upper surface generally perpendicularly to said center portion; and joining said upper surface and said wedge-shaped projection at an upper edge.

10. The method for fabricating a modular support arm of claim 9, further comprising the step of forming a rounded corner on said upper edge.

11. The method for fabricating a modular support arm of claim 8, further comprising the step of machining said upper surface.

12. The method for fabricating a modular support arm of claim 8, further comprising the step of forming an upwardly curving lower edge at the connection of said throat relief area and said wedge.

13. A rotary cone drill bit for forming a borehole, comprising:

a bit body having a number of pockets formed in the exterior of said bit body;

a number of support arms extending downwardly from and mounted on said bit body, said number of support arms equal in number to the number of pockets formed in said bit body, each of said support arms having a top surface, an inside surface, and a spindle connected to said inside surface, each spindle projecting generally downwardly and inwardly with respect to its associated support arm;

a number of cutter cone assemblies equaling said number of support arms and mounted respectively on one of said spindles;

each of said inside surfaces of each of said support arms comprising:

first and second angled surfaces, the lower portion of said first and second angled surfaces forming an inwardly projecting wedge having an upper and a lower edge;

a center portion between said first and second angled surfaces;

an upper surface extending perpendicularly from said center portion to said upper edge of said wedge; and a curving throat relief area extending from said lower edge of said wedge;

each of said pockets comprising a back wall, a lower surface connected to said back wall at a rounded edge, opposed inclined sides extending outwardly from said back wall, and a wedge-shaped recess formed by the combination of said inclined sides and said lower surface;

the dimensions of said top surface and said inside surface of each of said support arms selected to allow for securing a portion of said support arm within one of said respective pockets, and the dimensions of each of said wedges selected to allow for securing said wedge within said recess of one of said respective pockets; and means provided on said inside surface of each of said support arms and on each of said back walls of said pockets for alignment and positioning of said support arm within said pockets during fabrication of said drill bit.

14. The rotary cone drill bit of claim 13, wherein each of said pockets includes a lowermost edge formed at the connection of said pocket and said bit body;

wherein said bit body includes a groove extending in a triangular pattern along each of said lowermost edges of said pockets; and a length of weld in each of said weld grooves for securing each of said support arms to said bit body.

15. The rotary cone drill bit of claim 14, wherein each of said lower edges of said wedges is upwardly curving and includes an outermost point positioned adjacent one of each of said lowermost edges of said pockets.

16. The rotary cone drill bit of claim 13, wherein each of said upper edges of said wedges forms a rounded edge.

17. The rotary cone drill bit of claim 13, wherein the connection of each of said bottom surfaces and each of said inclined sides forms a rounded corner.

18. The rotary cone drill bit of claim 13, wherein each of said upper surfaces of each of said support arms is a machined surface; and wherein each of said bottom surfaces of each of said pockets is a machined surface.

19. The rotary cone drill bit of claim 13, wherein each of said pockets includes a lowermost edge at the connection of each of said pockets and said bit body;

wherein each of said lower edges of each of said wedges includes an outermost point positioned adjacent said lowermost edge of each of said pockets; and wherein said bit body includes a weld groove and weld extending in a triangular pattern around each of said lowermost edges for securing each of said support arms to said bit body.

20. The rotary cone drill bit of claim 13, wherein said means for alignment and positioning comprises first and second openings formed on each said support arms, and first and second posts positioned on the back wall of each of said pockets.

* * * * *